United States Patent [19]

Jaegtnes et al.

[11] 4,007,597

[45] Feb. 15, 1977

[54] POWER PLANT AND SYSTEM FOR ACCELERATING A CROSS COMPOUND TURBINE IN SUCH PLANT, ESPECIALLY ONE HAVING AN HTGR STEAM SUPPLY

[75] Inventors: Karl O. Jaegtnes, Chester Heights, Pa.; Andrew S. Braytenbah, Pennsauken, N.J.

[73] Assignee: Westinghouse Electric Corporation, Pittsburgh, Pa.

[22] Filed: Sept. 30, 1975

[21] Appl. No.: 618,097

[52] U.S. Cl. ..... 60/707; 60/663; 60/715; 60/644

[51] Int. Cl.[2] ..... F01K 13/02

[58] Field of Search ..... 60/706, 707, 660, 644, 60/662, 663, 715

[56] References Cited

UNITED STATES PATENTS

| | | | |
|---|---|---|---|
| 2,204,138 | 6/1940 | Knowlton et al. | 60/707 X |

FOREIGN PATENTS OR APPLICATIONS

| | | | |
|---|---|---|---|
| 601,541 | 4/1929 | Germany | 60/715 |
| 352,074 | 7/1931 | United Kingdom | 60/715 |
| 491,419 | 9/1938 | United Kingdom | 60/715 |

*Primary Examiner*—Allen M. Ostrager
*Attorney, Agent, or Firm*—E. F. Possessky

[57] ABSTRACT

An electric power plant having a cross compound steam turbine and a steam source that includes a high temperature gas-cooled nuclear reactor. The steam turbine includes high and intermediate-pressure portions which drive a first generating means, and a low-pressure portion which drives a second generating means. The steam source supplies superheat steam to the high-pressure turbine portion, and an associated bypass permits the superheat steam to flow from the source to the exhaust of the high-pressure portion. The intermediate and low-pressure portions use reheat steam; an associated bypass permits reheat steam to flow from the source to the low-pressure exhaust. An auxiliary turbine driven by steam exhausted from the high-pressure portion and its bypass drives a gas blower to propel the coolant gas through the reactor. While the bypass flow of reheat steam is varied to maintain an elevated pressure of reheat steam upon its discharge from the source, both the first and second generating means and their associated turbines are accelerated initially by admitting steam to the intermediate and low-pressure portions. The electrical speed of the second generating means is equalized with that of the first generating means, whereupon the generating means are connected and acceleration proceeds under control of the flow through the high-pressure portion.

29 Claims, 2 Drawing Figures

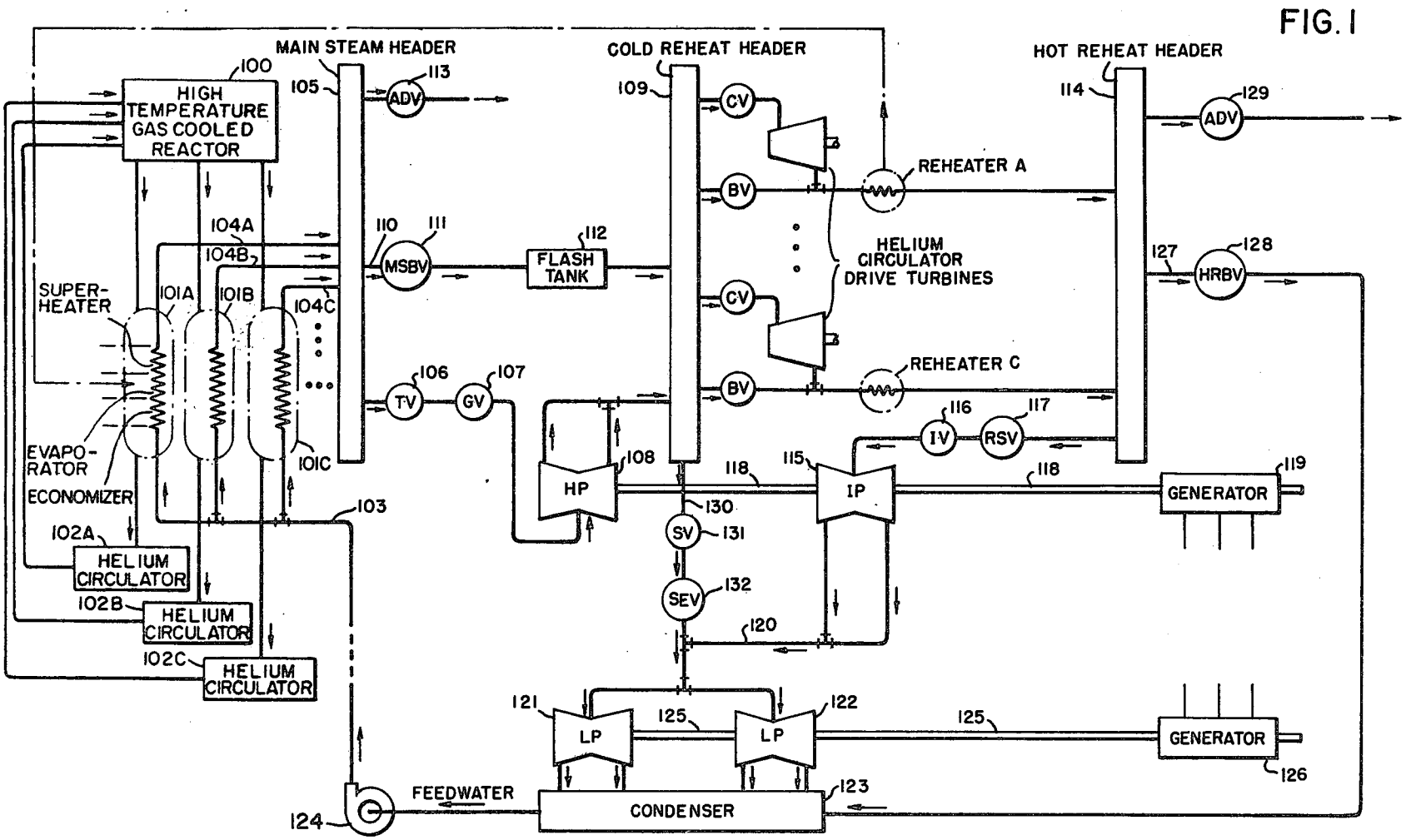
FIG. 1
HOT REHEAT HEADER
COLD REHEAT HEADER
MAIN STEAM HEADER
REHEATER A
REHEATER C
HELIUM CIRCULATOR DRIVE TURBINES
GENERATOR
GENERATOR
CONDENSER
FEEDWATER
FLASH TANK
HIGH TEMPERATURE GAS COOLED REACTOR
HELIUM CIRCULATOR
HELIUM CIRCULATOR
HELIUM CIRCULATOR
SUPER-HEATER
EVAPO-RATOR
ECONOMIZER
ADV
HRBV
RSV
IV
IP
CV
BV
CV
BV
SV
SEV
HP
GV
TV
MSBV
ADV
LP
LP
100
101A
101B
101C
102A
102B
102C
103
104A
104B
104C
105
106
107
108
109
110
111
112
113
114
115
116
117
118
119
120
121
122
123
124
125
125
126
127
128
129
130
131
132

POWER PLANT AND SYSTEM FOR ACCELERATING A CROSS COMPOUND TURBINE IN SUCH PLANT, ESPECIALLY ONE HAVING AN HTGR STEAM SUPPLY

CROSS REFERENCES TO RELATED APPLICATIONS

Reference is made to the following previously filed and copending applications assigned to the present assignee:

"HTGR Power Plant Hot Reheat Steam Pressure Control System", Ser. No. 463,027, now U.S. Pat. No. 3,894,394, filed on Apr. 22, 1974 by Andrew S. Braytenbah and Karl O. Jaegtnes;

"HTGR Power Plant Turbine-Generator Load Control System", Ser. No. 464,027, filed on Apr. 25, 1974 by Andrew S. Braytenbah and Karl O. Jaegtnes;

"Load Control System Especially Adapted For HTGR Power Plant Turbine", Ser. No. 497,608 filed on Aug. 15, 1974 by Ola J. Aanstad;

"Acceleration Control Arrangement For Turbine System, Especially For HTGR Power Plant", Ser. No. 519,703, filed on Oct. 31, 1974 by Ola J. Aanstad;

"Dual Turbine Power Plant and Method of Operating Such Plant, Especially One Having An HTGR Steam Supply", Ser. No. 571,145, filed on Apr. 24, 1975 by Andrew S. Braytenbah and Karl O. Jaegtnes;

"Electric Power Plant And Turbine Acceleration Control System For Use Therein", now U.S. Pat. No. 3,694,881, filed by Andrew S. Braytenbah and Karl O. Jaegtnes; and "A Dual Turbine Power Plant And A Reheat Steam Bypass Flow Control System For Use Therein", now abandoned, filed by Andrew S. Braytenbah and Karl O. Jaegtnes.

BACKGROUND OF THE INVENTION

A cross compound turbine-generator comprises a first generator which is rotated typically by the high and intermediate pressure portions of a steam turbine, and a second generator which is rotated by a low-pressure turbine portion. During acceleration of such a turbine-generator to its synchronous speed, the first and second generators are accelerated independently to a speed intermediate the turning gear speed and the synchronous speed, whereupon the generators are connected electrically. Then the shaft speed of the turbine-generator is increased from the intermediate to the synchronous speed.

The high-pressure portion of such a turbine-generator generally is connected to use superheat steam; in such case, steam that is exhausted from the high-pressure portion is reheated and returned for use by the intermediate and low-pressure portions. Typically a bypass line is connected across the high-pressure portion and another bypass line is connected across the intermediate and low-pressure portions. Such bypass lines permit a minimum passage of steam through the superheat and reheat sections of the steam source at times when the turbine steam flows are less than the minimum, thereby affording protection to the steam source from possible damage due to low-flow conditions.

In the event that a bypass system is connected across a turbine system as above described, the steam flow through the high-pressure portion and the flow through the intermediate low pressure portions may not be equal, at times when there is flow through the bypass lines.

If the steam source includes a high temperature gas-cooled nuclear reactor, hot coolant gas is discharged from the reactor and flows through a steam generator wherein reactor-generated heat is imparted to the flows of superheat and reheat steam. An auxiliary steam turbine means may be connected to use steam exhausted from the high-pressure turbine portion and its bypass line to drive a gas circulator, before such steam is reheated. The gas circulator propels the coolant gas through the reactor and the steam generator.

In case the steam source includes a high temperature gas-cooled nuclear reactor and an auxiliary steam turbine means is connected as above described, at least a minimum pressure of steam must be maintained at the exhaust of the auxiliary steam turbine means, for the proper and efficient operation of such means. As a result, steam that is discharged from the reheat section of the steam generator is at an elevated pressure when acceleration of the turbine-generator commences.

A proposed system for accelerating a cross compound turbine-generator commences acceleration by gradually opening the steam flow control valves associated with the high-pressure turbine portion, the steam flow control valve associated with the intermediate and low-pressure portions remaining fully open during the entire course of acceleration of the turbine-generator to its synchronous speed. At an intermediate speed, the low-pressure portion is accelerated by an equalizing steam flow until its rotational speed is equal to that of the high and intermediate pressure portions, whereupon the electrical generators are connected electrically. After such connection, acceleration continues under control of the steam flow valve associated with the high-pressure portion. The system apparently does not include the bypass lines associated with the turbine portions, as above described.

One limitation of the proposed system, in event of its application in a power plant wherein reheated steam is at an elevated pressure when acceleration commences, is that it permits an appreciable initial steam flow through the intermediate and low pressure turbine portions, making control of the shaft speed difficult, if not impossible. Another limitation of the system is that it permits an equal steam flow through the high, intermediate and low-pressure turbine portions, and therefore it is not adapted to a cross compound turbine with a bypass as above described, wherein the steam flows through the high and intermediate-low pressure portions need not be equal at times when there is steam flow the bypass lines.

There appears to be a need for an acceleration control system for a turbine system connected to a source of reheated steam that is at an elevated pressure when acceleration commences. Furthermore, there appears to be a need for an acceleration control system for use with a turbine and a bypass system wherein the steam flows through the turbine portions are controlled independently, for improved accuracy of acceleration control and for desirable heating and cooling of various turbine parts.

The description of prior art herein is made on good faith and no representation is made that any prior art considered is the best pertaining prior art nor that the interpretation based on its is unrebuttable.

SUMMARY OF THE INVENTION

In accordance with the present invention, a power plant includes a steam source to generate superheat and reheat steam which flows through a turbine-generator and an associated bypass system. A high-pressure and an intermediate-pressure turbine portion drive a first electrical generating means, and a low-pressure turbine portion drives a second electrical generating means. A first flow of superheat steam flows through the high-pressure portion, while a second flow of reheat steam flows through the intermediate and low-pressure portions in succession. Provision is made for bypassing steam around the turbine portions; in particular, one bypass means permits a flow of superheat steam from the steam source to the exhaust of the high-pressure portion, and another bypass means allows reheated steam to pass from the source to the exhaust of the low-pressure portion. The first and second steam flows are governed independently. While one of such flows is varied for purposes of controlling the rotational speed of the first generating means according to a desired speed, the other flow is varied to regulate a power plant variable at its desired level.

BRIEF DESCRIPTION OF THE DRAWINGS

FIG. 1 schematically shows a power plant including a cross compound turbine-generator and a steam source having a high temperature gas-cooled nuclear reactor.

DESCRIPTION OF THE PREFERRED EMBODIMENTS

Figure 2:
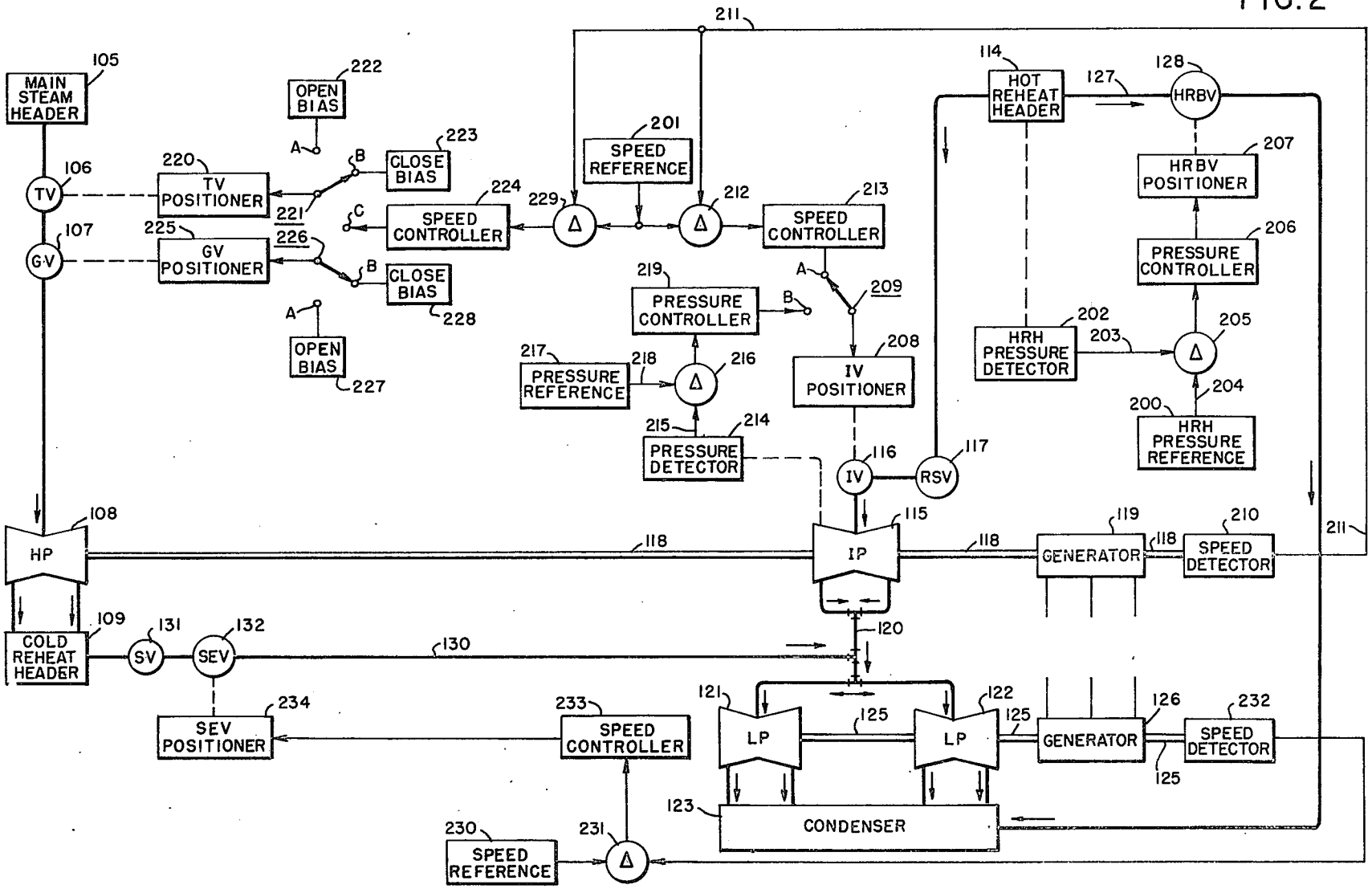
FIG. 2 shows a turbine acceleration control system adapted for use in the power plant according to FIG. 1.

Referring to FIG. 1, an electric power plant includes a steam source having a high temperature gas cooled reactor 100 which delivers hot coolant gas, in this case helium, to steam generators 101A, 101B and 101C, wherein heat is exacted from the coolant gas for generation of superheat and reheat steam. Upon discharge from the steam generators, the coolant gas flows through helium circulators 102A, 102B and 102C to an inlet of the reactor 100. As the coolant gas passes through the reactor 100, reactor-generated heat is imparted to the gas. Upon its discharge from the reactor 100, hot coolant gas returns to the steam generators 101A, 101B and 101C. The helium circulators 102A, 102B and 102C propel the coolant gas through the reactor 100 and through the respective steam generators 101A, 101B and 101C.

Feed water is introduced to each of the steam generators on a line 103; within each steam generator feed water is warmed in an economizer section, evaporated in an evaporator section, and heated to a superheat condition in a superheater section. The superheat steam is discharged from the steam generators 101A, 101B and 101C through respective lines 104A, 104B and 104C, which lines conduct the superheat steam to a main steam header 105.

From the main steam header 105, steam may pass through a throttle valve 106 and a governor valve 107 to an inlet of a high pressure turbine portion 108. After its passage through the turbine portion 108, steam is exhausted to a cold reheat header 109. To permit a minimum passage of steam through the superheater sections of the steam generators 101A, 101B and 101C, a bypass line 110 is connected between the headers 105 and 109. A main steam bypass valve (MSBV) is connected to control the flow of steam through the line 110, and a flash tank 112 may be used to desuperheat the steam passing through the line 110, before such steam is discharged to the header 109. An atmospheric discharge valve 113 is connected to control the flow of steam from the header 105 to atmosphere; the valve 113 is opened only in event that an excessive flow of steam would otherwise be required through the line 110. A desired minimum flow of steam through the superheater sections of the steam generators 101A, 101B and 101C typically is 25 percent of the flow of such steam when the power plant generates its full power output.

From the cold reheat header 109, steam passes through a plurality of auxiliary steam turbines and their associated bypass lines to the inlets of reheaters A, B and C. Each of the auxiliary steam turbines is a drive turbine which is rotatably coupled to drive a corresponding one of the helium circulators 102A, 102B and 102C. Generally, it is desirable to vary the flow rate of coolant gas through the reactor 100 as the level of the power output of the power plant is varied. Since the flow rate of coolant gas depends upon the speed of rotation of the helium circulator drive turbines, a valve is connected between the header 109 in the steam inlet of each of the helium circulator drive turbines, for purposes of controlling steam flow through that turbine and thus the flow of coolant gas through its corresponding helium circulator. A bypass valve is connected between the header 109 and the steam exhaust of each of the auxiliary steam turbines, to permit passage of steam from the header 109 at times when the total steam flow through the auxiliary steam turbines is less than the total flow of steam into the header.

Steam that is exhausted from an auxiliary steam turbine and its associated bypass valve passes to an inlet of a corresponding reheater. It should be understood that each of the reheaters as shown in FIG. 1 is preferably included in a corresponding one of the steam generators 101A, 101B and 101C; in particular, the dash line between the reheater A and the steam generator 101A illustrates the inclusion of that reheater in the specified steam generator. Each reheater derives heat from the coolant gas that flows through its respective steam generator for purposes of reheating the flow of steam that is delivered to the inlet of the reheater by the corresponding auxiliary steam turbine and bypass valve. Reheated steam is discharged from each reheater and passes to the hot reheat header 114.

An intermediate pressure turbine portion 115 is connected to use a flow of reheated steam from the header 109, the flow of steam through the portion 115 being controlled by the series connected steam control valves 116 and 117. The valve 116 is an intercept valve which is positioned to control the flow of steam through the turbine portion 115. The valve 117 is a reheat stop valve having two positions; such valve either is fully open to permit a flow of steam through the turbine 115, or it is fully closed to prohibit such flow.

The high pressure turbine portion 108 and the intermediate turbine portion 116 turn on a common shaft 118 to drive a generator 119 which is coupled through the shaft 118 for rotation with such turbine portions. The generator 119 produces an electrical power that is delivered by output lines to a power network (not shown).

After its passage through the intermediate pressure turbine portion 115, steam passes through a line 120 that is connected between a steam exhaust of the turbine portion 115 and a steam inlet of each of low pressure turbine portions 121 and 122. After its passage through the turbine portions 121 and 122, spent steam is exhausted from such portions to a condenser 123. The condenser 123 condenses the steam that is delivered to it, the condensed steam being discharged from the condenser as feedwater which is returned by a feedwater pump 124 to the line 103, which returns the feedwater to the steam generators 101A, 101B and 101C, wherein the feedwater is converted to superheat steam, as previously described.

The low pressure turbine portions 121 and 122 turn on a common shaft 125 which is coupled to drive an electric generator 126. The generator 126 delivers electric power on its output lines to a power network (not shown). At times when the electric power plant of FIG. 1 delivers power to its associated power network, the generators 119 and 126 are electrically connected one with another, and with the power network.

It is desirable to maintain a minimum passage of steam through the reheaters A, B and C, in order to protect such reheater sections from possible damage due to low steam flow. The desired minimum flow of steam through the reheater sections typically is equal to the flow of steam through the intermediate and low pressure turbine portions when the power output of the power plant is at 25 percent of its maximum value. In order to maintain such a desired minimum flow through the reheater sections at times when the flow through the intermediate and low pressure turbine portions is less than such minimum, a bypass line 127 is connected to pass steam from the header 14 directly to the condenser 123. A hot reheat bypass valve (HRBV) is connected to govern the flow of steam through the line 127. Generally the valve 128 is positioned in order to maintain a desired pressure of steam in the hot reheat header 114, such desired pressure corresponding to the desired minimum flow of steam through the reheater sections.

It should be understood that the value of such desired steam pressure in the header 114 effects the pressure of steam at the inlets of the reheaters A, B and C, which pressures are the back pressures against which the auxiliary steam turbines operate. Thus the desired pressure of steam in the header 114 is compatible with back pressures which afford efficient operation of the auxiliary steam turbines. The bypass valve associated with an auxiliary steam turbine is positioned to permit a desired pressure differential between the header 109 and the steam exhaust of the auxiliary turbine.

An atmospheric discharge valve (ADV) 129 is connected to permit a flow of reheated steam from the header 114 to the atmosphere; however the valve 129 is opened only at times when the steam flow through the line 127 would otherwise be excessive. A line 130 is connected to pass a flow of steam from the cold reheat header 109 to the inlets of the low pressure portions 121 and 122. The flow through the line 130 is supplemental to the flow through the line 120. As will be described hereinafter, the flow through the line 130 is an equalizing steam flow that is used to accelerate the electrical speed of the generator 126 until such speed is equal to the electrical speed of the generator 119, whereupon the generators may be connected electrically. A two-position stop valve (SV) 131 is used to permit or to prohibit a flow of steam through the line 130. A speed equalizer valve (SEV) 132 is connected to control the flow of steam through the line 130 at times when the valve 131 is open.

Referring now to FIG. 2 there is shown a system for controlling the acceleration of the turbine-generator included in the power plant of FIG. 1 from its turning gear speed to its synchronous speed. During such acceleration, the pressure of steam in the hot reheat header 114 is regulated at a reference value that is specified by a pressure reference source 200, the steam flow through the line 127 being varied to accomplish such regulation. After each turbine-generator is disengaged from its turning motor (not shown) the reheat stop valve 117 is opened, and the steam flow through the turbine portions 115, 121 and 122 is varied to accelerate the shaft 118 in accordance with a speed reference signal from a source 201. During such acceleration, no steam is permitted to flow through the high pressure portion 108, while the low pressure shaft 125 turns at a somewhat lower speed than that of the shaft 118.

When the speed of the shaft 118 reaches X rpm, which typically is ½ the synchronous speed of such shaft, the shaft 125 is accelerated by varying the steam flow through the line 130 to equalize the speeds of the generators 119 and 126, whereupon the generators are connected electrically. After such electrical connection a flow of steam through the high pressure portion 108 is initiated and varied for purposes of governing the acceleration of the generators until they are synchronized with their associated power network (not shown). At times when acceleration is controlled by varying the flow of steam through the turbine portion 108, the flow through the turbine portions 115, 121 and 122 is governed by positioning the intercept valve 116 to regulate the pressure of steam in the first stage of the turbine portion 115 according to a constant desired value of that pressure.

In more detail with respect to FIG. 2, a pressure detector 202 is connected to detect the pressure of steam in the hot reheat header 114, which detector generates an output signal on the line 203 that is representative of the detected pressure value. The source 200 generates an output signal on a line 204 having a signal level which represents a desired value of the pressure of steam in the header 114. The signals on the lines 203 and 204 are transmitted to first and second inputs of a comparison device 205, which generates an output signal representative of a difference between the desired and detected pressure values. The output signal of the comparison device 205 is transmitted to an input of a pressure controller 206, which is responsive to its input signal to govern the position of the valve 128, thereby varying the steam flow through the line 127 to reduce the signal on the line 205 preferably to a level at which there is no steady state difference between the detected and the desired pressures of steam in the header 114. The pressure controller 206 in this case is a proportional-plus-integral controller which generates an output signal which is the sum of two components; a first component is proportional to the input signal of the controller; and a second component signal is proportional to the time integral of the input signal. The output signal of the controller 206 is coupled to an input of a valve positioner 207, which positions the valve 128 at a position which corresponds to the level of its input signal. Preferably the valve positioner 207 is of the electrohydraulic type, that is, it moves the valve 128 under hydraulic power to a position which is specified by the electrical input signal that is generated by the controller 206.

During acceleration of the turbine-generator included in the power plant of FIG. 1, the source 200 generates a pressure reference of a level that causes the desired minimum flow of steam through the reheater sections of the steam generators (FIG. 1) to pass through the bypass line 127 to the condenser 123, when the valve 128 is positioned to regulate the detected pressure of steam in the header 114 at the desired level.

The intercept valve 116 is positioned by a valve positioner 108, in this case an electrohydraulic type as previously described. An input signal is transmitted to the positioner 208 by a switch 209, which switch is set in the A position at speeds of the shaft 118 that are lower than a distinct value, such as X rpm. At shaft speeds in excess of such distinct value, the switch 209 is placed in the B position. When placed in the A position, the switch 209 transmits a signal to the positioner 208 to vary the position of the intercept valve 116 to govern the detected speed of the shaft 118; in position B the intercept valve 116 is positioned to govern the detected pressure of steam in the first stage of the turbine portion 115.

A speed detector 210 is connected to measure the rotational speed of the shaft 118, and to generate an output signal on a line 211 representative of the measured speed. In this case, the detector 210 includes a toothed wheel that is attached to the shaft 118 for rotation with the shaft. A stationary pickup generates a pulse signal each time a tooth of the attached wheel passes the pickup. Thus the frequency of the generated pulses is related to the rotational speed of the shaft 118. The pulses are coupled to an input of a signal converter which generates a signal on the line 211, the level of such signal being in accordance with the frequency of the pulses and thus with the rotational speed of the shaft 118.

The output signal of the source 201, representative of a desired value of the rotational speed of the shaft 118, and the signal on the line 211, representative of a detected value of such speed, are coupled to first and second inputs of a comparison device 212, which generates an output signal that represents a difference between detected and desired speed values. A speed controller 213, such as a proportional-plus-integral controller, generates an output signal in response to the output signal of the comparison device 212. The output signal of the controller is transmitted to the A terminal of the switch 209; at times when such switch is placed in the A position, the positioner 208 positions the valve 116 according to the output signal of the controller 213, to vary the flow of steam through the turbine portions 115 and the low pressure portions 121 and 122, whereby a difference between the detected and desired value of the rotational speed of the shaft 118 is reduced to a zero steady state level.

A pressure detector 214 is connected to measure the pressure of steam in the first stage of the intermediate pressure turbine portion 115. The detector 214 generates an output signal on a line 215 that is connected to an input of a comparison device 216, the signal on the line 215 representing the value of the detected steam pressure. A source 217 generates an output signal on a line 218 that represents a desired value of the pressure of steam in the first stage of the turbine portion 115, the line 218 being connected to a second input of the comparison device 216. The output signal of the comparison device 216, representative of a difference between the detected and desired values of the first stage steam pressure, is fed through a pressure controller 219 to the terminal B of the switch 209. The controller 219, preferably a proportional-plus-integral controller, generates an output signal in response to a difference of pressure values, such output signal being transmitted through the switch 209 (in the position B) to the input of the positioner 208. When the valve 116 is positioned according to the output signal of the controller 219, the steam flow through the turbine portion 115 is varied to cause a reduction of a difference between the desired and detected steam pressure values, as represented by the output signal of the comparison device 216. In the steady state, such a difference is reduced to zero.

A throttle valve positioner 220, such as an electrohydraulic valve positioner, positions the valve 106 according to a signal that is coupled to an input of the valve positioner by a switch 221. If placed in position A, the switch 221 transmits an output signal of a source 222 to the positioner 220, the level of such signal being sufficiently high to bias the valve 106 fully open. In its position B, the switch 221 transmits an output signal from a source 223 to the positioner 220, to bias the valve 106 closed. At position C, the switch 221 delivers an output signal of a speed controller 224 to the positioner 220, for purposes described hereinafter.

A valve positioner 225, preferably electrohydraulic, positions the governor valve 107 according to a signal that is coupled to an input of the positioner 225 by a switch 226. In position A, the switch 226 couples an output signal of a source 227 to bias the valve 107 fully open; in position B, the switch couples an output signal of a source 228 to bias the valve 107 closed; in position C, the output signal of the controller 224 is transmitted to the input of the positioner 225.

The detected speed signal on the line 211 and the desired speed signal from the source 201 are coupled to first and second inputs of a comparison device 229, which transmits a signal representative of a difference between the desired and detected speed values to an input of the controller 224. In event that the output signal of the controller 224 is coupled to one of the valve positioners 220 and 225, one of the valves 106 and 107 is positioned to vary the flow through the high-pressure turbine portion 108 to reduce the output signal of the comparison device 229 to a level corresponding to zero difference between the detected and desired speed values. As will be seen, that one of the valves 106 and 107 which is not positioned for speed control purposes, is biased fully open.

A source 230 generates an output signal which represents a desired value of the rotational speed of the shaft 125, which signal is coupled to a first input of a comparison device 231. A speed detector 232 detects the rotational speed of the shaft 125 and generates an output signal representing a detected speed value, such output signal being applied to a second input of the comparison device 231. The device 231 generates an output signal representative of a difference between the detected and desired values of the shaft speed. In response to the output signal of the device 231, a speed controller 233 generates an input signal to a valve positioner 234, which positions the valve 132 according to the signal generated by the controller 233. Preferably the controller 233 is a proportional-plus-integral controller, in which case variation of the position of the valve 132 in accordance with the output signal of the controller reduces the difference between the speed values, as represented by the output signal of the comparison device 231, until such difference is reduced to a zero steady state level.

Usually the stop valve 131 is closed, in which event there is no steam flow through the line 130. However, at times when it is desired to equalize the speed of the shaft 125 with the speed of the shaft 118, the valve 131 is opened, and the speed controller 233 varies the flow through the line 130 until the speed detected by the detector 232 is equal to the desired speed that is specified by the output signal of the source 230.

At times when it is desired to accelerate the turbine-generator from its turning gear speed to its synchronous speed, the shafts 118 and 125 are disengaged from their turning motors (not shown). Acceleration is commenced by opening the reheat stop valve 117 and governing the flow of steam through the turbine portion 115 and through the portions 121 and 122 to control the detected speed of the shaft 118 according to a reference speed from the source 201. The reference speed is increased gradually from the turning gear speed to X rpm at a rate that does not subject any parts of the turbine portions 115, 121 and 122 to harmful thermal conditions. During acceleration of the shaft 118 to X rpm at least one of the throttle valves 106 and the governor valve 107 preferably is closed, so that the speed of the shaft 118 is controlled solely by the valve 116.

At any time during acceleration of the shaft 118 to X rpm, the rotational speed of the shaft 125 is less than the corresponding speed of the shaft 118, due to the reduced efficiency of the turbine portions 121 and 122, over such speed range, as such portions must accelerate the shaft 125 using exhaust steam from the turbine portion 115. As the shaft 118 is accelerated to X rpm, the valve 131 is closed and no steam flows through the line 130.

During the entire course of acceleration of the turbine-generator, the source 200 produces a preferably constant reference pressure, and the flow through the line 127 is varied to govern the pressure value as detected by the detector 202 in accordance with the desired pressure value as specified by the signal on the line 204. Thus, the desired minimum flow of steam through the reheaters (see FIG.1) is maintained during acceleration, and control of the speed of the shaft 118 is improved as a result of improved control of the steam flow through the valve 116 due to the substantially constant pressure of steam in the hot reheat header 114.

It should be understood that as the steam flow through the valve 116 is increased to accelerate the shaft 118 to X rpm, the flow through the line 127 is decreased correspondingly, in order to maintain the detected pressure of steam in the header 114 at the level that is specified by the output signal of the source 200.

The output signal of the source 201, which specifies a desired speed of the shaft 118, is increased until it reaches X rpm, whereupon the signal remains at such value until the generators 119 and 126 are connected electrically. As the shaft 118 is accelerated to X rpm, the switch 209 remains in the A position whereby the valve 116 is positioned according to the output signal of the speed controller 213. Each of the switches 221 and 226 is placed in its B position over such speed range to hold its corresponding steam flow control valve closed.

When the speed of the shaft 118 reaches X rpm, the output signal of the source 201 is held constant at the level that specifies such speed. The source 230 is set to generate a desired speed for the shaft 125 such that the electrical speeds of the generators 119 and 126 are equal. It should be understood that such desired speed is less than the actual speed of the shaft 126 when the shaft 118 turns at X rpm, and that steam flow through the line 130 is required to permit the shaft 125 to accelerate to the desired speed. Therefore, the stop valve 131 is opened, and the flow through the line 130 is varied to accelerate the shaft 125 to the desired speed that is specified by the output signal of the source 230. During such acceleration, the speed of the shaft 118 is constant at X rpm.

When the speed of the shaft 125 reaches the desired value at which the electrical speeds of the generators 119 and 126 are equal, the generators are connected electrically (by means not shown). After such connection, the stop valve 131 is closed to terminate steam flow through the line 130. Closing the valve 131 tends to cause the speed of the shaft 118 to decrease somewhat, but such decrease is detected by the comparison device 212, and the speed controller 213 responsively increases the flow of steam through the valve 116 to return the speed of the shaft 118 to X rpm.

With the generators 119 and 126 connected electrically and the shaft 118 turning at X rpm the source 217 is set to produce an output signal representative of the pressure of steam in the first stage of the turbine portion 115, as detected by the detector 214 under such conditions. The switch 209 then is placed in its B position, whereby the valve 116 is positioned according to the output signal of the pressure controller 219. The switch 209 remains in the B position as the turbine-generator accelerates from X rpm to its synchronous speed. By holding the steam pressure in the first stage of the turbine portion 115 at a constant level over such speed range, an effectively constant steam flow is maintained through the turbine portion 115 and through the low-pressure portions 121 and 122. Thus, there is an effectively constant flow of steam to warm parts of the intermediate pressure portion 115 and to cool parts of the low-pressure portions 121 and 122, especially parts that are near the steam exhausts of the low-pressure portions. In addition, such an effectively constant steam flow permits improved control of the speed of the shaft 118 between X rpm and synchronous speed, which control is effected by varying the flow through the turbine portion 108.

It should be noted that the constant level of the steam pressure in the header 114 which is maintained through the course of acceleration from X rpm to synchronous speed, reduces both the degree and the frequency at which the valve 116 is moved for purposes of maintaining the desirably constant level of flow through the turbine portion 115.

The switch 226 is placed in its A position to open fully the governor valve 107. After the valve 107 is fully opened, the switch 221 is placed in the C position, to couple the output signal of the speed controller 224 to the input of the throttle valve positioner 220. Thus, the previously closed valve 106 is opened to initiate a flow of steam through the turbine portion 115, which flow is varied by the controller 224 for purposes of governing the detected speed of the shaft 118 according to the desired value that is specified by the output signal of the source 201. It should be understood that with the generators 119 and 126 electrically connected, the electrical speeds of such generators remain synchronized. As the turbine- generator is accelerated from X rpm (of the shaft 118) to synchronous speed, therefore, it is necessary only to detect and regulate the rotational speed of the shaft 118.

With the switches 221 and 226 remaining in the positions C and A respectively, the output signal of the source 201 is increased from a level corresponding to X rpm to a level which represents the rotational speed that is intermediate to X rpm and that rotational speed of the shaft 118 at which the electrical speeds of the generators 119 and 126 are synchronized with the associated power network (not shown). The speed controller 224 positions the throttle valve 106 to increase the steam flow through the turbine portion 108, thereby causing the detected rotational speed of the shaft 118 to increase in accordance with the speed reference signal from the source 201. When the rotational speed of the shaft 118 reaches the aforementioned intermediate speed, control of the rotational speed of such shaft is transferred from the throttle valve 106 to the governor valve 107. Such transfer is accomplished by placing the switch 226 in its B position to close the valve 107. After the valve 107 is fully closed, the switch 221 is placed in the A position to fully open the throttle valve 106. With the valve 106 fully opened, the switch 226 is placed in the C position to couple the output signal of the controller 224 to the input of the governor valve positioner 225. During the course of such transfer, the output signal of the source 201 preferably remains constant. The rotational speed of the shaft 118 may decrease somewhat during the time interval that the valve 107 is fully closed. However, at the time that the switch 226 is placed in the position C such a decrease is detected by the comparison device 229, and the speed controller 224 responsively varies the governor valve 107 to return the detected speed of the shaft 118 to its reference value.

Upon completion of the control transfer from the throttle valve 106 to the governor valve 107, the output signal of the source 201 is increased from its level at which such transfer is made to a level at which the electrical speeds of the generators 119 and 126 are synchronous with the power network (not shown). In response, the speed controller 224 positions the governor valve 107 to increase the steam flow through the high pressure turbine portion 108, whereby the speed detected by the detector 210 is increased according to the speed reference from the source 201.

What is claimed is:

1. A power plant comprising, a steam source to generate superheat and reheat steam;

a cross compound turbine-generator including, a high pressure turbine portion operated by a first flow of superheat steam, an intermediate turbine portion operated by a second flow of reheat steam, and a first electrical generating means rotatably driven by said high and intermediate pressure turbine portions, and a second electrical generating means rotatably driven by a low pressure turbine portion operated by the second flow after it is exhausted from the intermediate pressure portion;

first bypass means for conducting a flow of superheat steam from said steam source to a steam exhaust of said high pressure turbine portion;

second bypass means for conducting a flow of reheat steam from said steam source to a steam exhaust of said low pressure turbine portion; and control means for independently governing the first and second flows, wherein one of the first and second flows is varied for purposes of controlling the rotational speed of said first electrical generating means in accordance with a desired value of such speed, while the other of the first and second flows is varied to regulate a power plant variable in accordance with its desired value.

2. A power plant according to claim 1 further comprising means for passing an equalizing steam flow through said low pressure turbine portion in order to increase the rotational speed of said second electrical generating means at times when the rotational speed of said first electrical generating means is effectively constant.

3. A power plant according to claim 2 further comprising means for electrically connecting said first and second electrical generating means when their rotational speeds are effectively equal.

4. A power plant according to claim 1 wherein said steam source includes a high-temperature gas-cooled nuclear reactor and a steam generator to produce the superheat and reheat steam using heat derived from the coolant gas of said reactor.

5. A power plant according to claim 4 wherein an auxiliary steam turbine means is connected to use steam that is generated by said steam source for driving a means for circulating the coolant gas through said reactor and said steam generator.

6. A power plant according to claim 5 wherein said auxiliary steam turbine means uses steam that is exhausted from said high-pressure turbine portion and said first bypass means.

7. A power plant according to claim 1 wherein the first steam flow is constant while the second steam flow is varied for speed control at times when the rotational speed of said first electrical generating means is less than a distinct value.

8. A power plant according to claim 7 wherein the constant level of the first steam flow is zero.

9. A power plant according to claim 7 wherein the first steam flow is varied for speed control at times when the rotational speed of said first electrical generating means exceeds the distinct value.

10. A power plant according to claim 9 wherein the second steam flow is varied to maintain a desired pressure of steam in the first stage of said intermediate pressure turbine portion at times when the first steam flow is varied for purposes of speed control.

11. A power plant according to claim 10 wherein the desired value of the first stage pressure is the value of such pressure at the time of commencement of variation of the first flow for speed control purposes.

12. A power plant according to claim 10 wherein the level of the first steam flow is zero at times when the second steam flow is varied for speed control purposes.

13. A power plant according to claim 1 wherein said control means include a governor valve means and a throttle valve means in series connection with said governor valve means, said governor valve and throttle valve means being connected to control the first steam flow, said governor valve means being positioned to vary the first steam flow at times when the rotational speed of said first electrical generating means exceeds a distinct value, and said throttle valve means being positioned to vary the first steam flow at times when such rotational speed is less than the distinct value.

14. A power plant according to claim 13 wherein one of said governor valve and throttle valve means is held fully open at times when the other of such valve means is positioned to vary the first steam flow.

15. A system for controlling the rotational speed of a turbine-generator, said turbine-generator having a first turbine portion rotatably coupled to drive a first electrical generating means and a second turbine portion rotatably coupled to drive a second electrical generating means, said turbine portions being connected to a steam supply such that a first flow of steam passes through a high-pressure section of said first turbine portion and a second flow of steam passes through an intermediate pressure section of said first turbine portion and through said second turbine portion so that the first and second flows may differ in level, said system comprising, a source to generate a reference value of the rotational speed of said first turbine portion, a detector to detect the rotational speed of said first turbine portion and to generate a representation of the detected speed, and means responsive to the reference and detected speed values for controlling the first and second flows, wherein one of the first and second flows is varied to regulate the detected rotational speed according to its desired value, that one of the first and second flows which is not used for speed regulation being held substantially constant or varied to regulate a variable associated with said turbine-generator and its steam supply according to a desired value of such variable.

16. A system according to claim 15 wherein that one of the first and second flows which is not used for speed regulation is zero at times when it is substantially constant.

17. A system according to claim 15 wherein the second steam flow is varied for purposes of speed regulation at times when the rotational speed of said first turbine portion is less than a distinct value.

18. A system according to claim 17 wherein the first flow is zero at times when the rotational speed of said first turbine portion is less than the distinct value.

19. A system according to claim 15 wherein the second flow is varied to regulate a detected pressure of steam within the intermediate pressure section of said first turbine portion according to a desired value of such pressure at times when the first flow is varied to regulate the rotational speed of said first turbine portion.

20. A system according to claim 15 further comprising, means for passing a third steam flow through said second turbine portion at times when it is desired to equalize the electrical speeds of said first and second generating means, and wherein said means for controlling varies the third steam flow to increase the electrical speed of said second generating means until such speed is equal to the electrical speed of said first generating means.

21. A system according to claim 20 wherein the second flow is varied for purposes of holding the electrical speed of said first generating means constant at times when the third flow is varied to equalize the electrical speeds of said first and second electrical generating means.

22. A system according to claim 21 wherein the first flow is zero at times when the electrical speeds are equalized.

23. A system according to claim 21 wherein the rotational speed of first turbine portion is held constant at a distinct value at times when the electrical speeds of said first and second generating means are equalized, the first steam flow being varied for purposes of regulating the rotational speed of said first generating means when such speed exceeds the distinct value.

24. A system according to claim 23 wherein the level of the third flow is zero at times when the rotational speed of said first turbine portion is regulated by varying the first flow.

25. A system according to claim 23 wherein the second flow is varied to maintain a desired value of the pressure of steam within the intermediate pressure section of said first turbine portion at times when the first flow is varied for purposes of speed regulation.

26. A system according to claim 25 wherein the desired value of the steam pressure within the intermediate pressure section is the value of such pressure at the time the electrical speeds of said first and second generating means are equalized.

27. A system according to claim 15 wherein said steam supply includes means for passing a fourth flow of steam around the intermediate pressure section of said first turbine portion and said second turbine portion to the exhaust of said second turbine portion, and further comprising, means for detecting a pressure of steam at a point in said steam supply such that the first and second flows pass through such point, and for generating a representation of the detected steam pressure, and wherein said means for controlling varies the fourth flow to regulate the detected pressure according to a desired value thereof.

28. A system according to claim 27 wherein the desired value of the regulated steam pressure is such that the sum of the second flow with the fourth flow is equal to a desired minimum flow at times when the second flow is less than the desired minimum.

29. A system according to claim 28 wherein the level of the desired minimum flow is equal to the level of the second flow at times when the combined power output of said first and second generating means is equal to a predetermined distinct value.

* * * * *